US005806969A

United States Patent [19]

Rosengren

[11] Patent Number: 5,806,969

[45] Date of Patent: Sep. 15, 1998

[54] LIGHTING DEVICE

[75] Inventor: Lars Rosengren, Huskvarna, Sweden

[73] Assignee: ITAB Industri AB, Jonkoping, Sweden

[21] Appl. No.: 713,862

[22] Filed: Sep. 13, 1996

Related U.S. Application Data

[63] Continuation of PCT/SE95/00262 Mar. 14, 1995.

[30] Foreign Application Priority Data

Mar. 16, 1994 [SE] Sweden ..... 94700875

[51] Int. Cl.[6] ..... F21V 1/00

[52] U.S. Cl. ..... 362/235; 362/337; 362/800

[58] Field of Search ..... 362/800, 337, 362/329, 332, 244, 80, 282–284, 338

[56] References Cited

U.S. PATENT DOCUMENTS

| | | | |
|---|---|---|---|
| 2,068,805 | 1/1937 | Lebby | 362/337 |
| 4,214,168 | 7/1980 | Kulka | 362/235 |
| 4,630,180 | 12/1986 | Muraki et al. . | |
| 4,669,034 | 5/1987 | Bansbach et al. . | |
| 4,862,330 | 8/1989 | Machida et al. | 362/800 |
| 4,935,665 | 6/1990 | Murata | 362/800 |
| 5,032,963 | 7/1991 | Granstrom | 362/337 |

FOREIGN PATENT DOCUMENTS

| | | |
|---|---|---|
| 449219 | 10/1991 | European Pat. Off. . |
| 2563929 | 11/1985 | France . |
| 2586847 | 3/1987 | France . |
| 2588109 | 4/1987 | France . |
| 2655173 | 5/1991 | France . |
| 25 20 429 | 11/1976 | Germany . |

*Primary Examiner*—James C. Yeung
*Attorney, Agent, or Firm*—Cushman Darby & Cushman IP Group of Pillsbury Madison & Sutro LLP

[57] ABSTRACT

The present invention is for a lighting device by which a controlled light pattern is obtained from a specific light source. The device comprises a light source which emits several parallel light beams. There is one prism (3) for each light beam (8), which passes through the lighting device. All of the prisms are integrated parts of a common disc. Preferrably the light source comprises several light emitting diodes (1) each emitting one light beam. The prisms are suitably made as straight, circular cylinders, at least those parts thereof which protrude from the common disc. The oblique surface may be freely varied at both its angle at the axis of the cylinder and direction whereby the direction of the corresponding light beam may be controlled.

9 Claims, 1 Drawing Sheet

LIGHTING DEVICE

This application is a continuation of PCT/SE95/00262 filed Mar. 14, 1995.

BACKGROUND OF THE INVENTION

1. Field of the Invention

The present invention is for a lighting device by means which a controlled light pattern is obtained from a specific light source. Controlled means that the light as projected on a flat surface produces a light pattern of a predetermined intensity and shape. The device according to the invention is primarily intended to be used for traffic light posts.

2. Description of the Related Art

It is often desirous that the light from a light source be recognized by individuals or other means primarily when they are at a specific position within a defined area. The effective output required from the light source may be reduced if the light from the light source is concentrated to the desired area.

It is known to make use of different kinds of light sources as well as light reflecting or refracting devices in order to obtain a desired light pattern. Thus it is known to have the light from an electric bulb to be reflected by a preferably parabolic reflector and then pass through a lens or prism setup. This may comprise a single lens or prism but there may also be several of these, functioning together in different ways. Instead of electric bulbs, light emitting diodes may be used. Different kinds of these are available which emit light as a concentrated, directed beam of specific intensity, spreading angle and wave length span.

Devices of the kind mentioned above are found both as headlights and lamps for different kinds of vehicles and as traffic signal lights. Especially for the last mentioned application, known devices have primarily been intended to give an acceptably concentrated light beam having an essentially circular cross section, whereby a comparatively large border area with diffuse light refraction is obtained.

SUMMARY OF THE INVENTION

The object of the present invention is to provide a lighting device, by means which a carefully controlled light pattern of predetermined intensity and shape is obtained. The device according to the invention also makes individual variations and adaptions to specific applications possible. This is obtained thereby that the device comprises a light source which emits a number of parallel light beams. A prism is arranged for each light beam such that the corresponding light beam passes through the prism. All of the prisms are integral parts of a common disc. Preferably the light source comprises a number of light emitting diodes, each of them emitting one light beam. The light emitting diodes, which in one device may be individually different with respect to e. g. luminance, are suitably mounted onto a common flat plate.

The common disc of the prims has one preferably flat surface on the side facing away from the light source. A smooth, flat surface brings advantages, e. g. by being dirt repellant and easy to clean if necessary. Also from a production point of view a flat surface is advantageous as compared to, e.g., a curved, smooth surface, making it possible to keep down the costs for moulds and tooling. This surface will be one outer side of the lighting device and be turned towards a viewer. Each one of all of the prisms is an integrated part of this common disc, which means that they are parts of the fixed disc construction and in a preferred embodiment the prisms and the disc constitute one piece of homogenous goods. In other embodiments individual prisms may be mounted into holes intended for this purpose in the disc. Disc and prisms may then be made from the same or from different materials. Essentially all of the light which is emitted from the device passes through the prisms. Suitably, the prisms—at least those parts thereof which protrude from the common disc—are shaped as straight circular cylinders. Each such prism has one end surface which is essentially at a right angle to the axis of the cylinder and one end surface which is oblique thereto. The surface which is at a right angle to the axis preferably coincides with the flat surface of the common disc, i. e., its outer surface. The complete device thus has a common flat outer surface. If the common disc, e. g., has a curved outer surface the ends of the prisms which coincide with this surface will not be at exactly right angles to the axis of the cylinder. The oblique surface may have a freely variable angle relative to the axis of the cylinder and freely variable direction of its slope whereby the direction of the corresponding light beam is controlled.

BRIEF DESCRIPTION OF THE DRAWINGS

The invention will be further illustrated below by the examples of embodiments thereof which are shown in the figures.

DETAILED DESCRIPTION OF THE PREFERRED EMBODIMENTS

Figure 1:
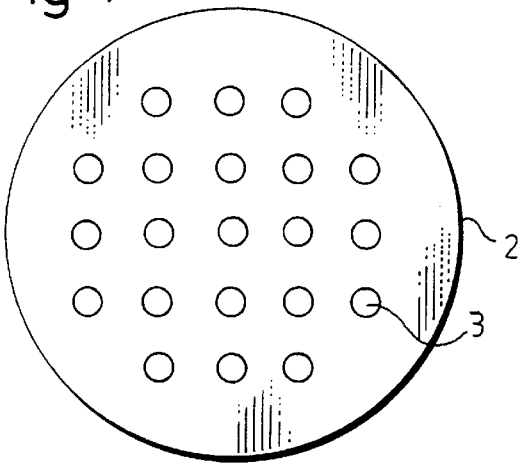
FIG. 1 shows a disc with prisms as seen from the inside of the device.

The common disc 2, as shown in FIG. 1, has a flat outer surface facing downwards in the figure. At the disc and protruding upwards from its surface are several prisms 3 having circular cross sections. The number of prisms and there positions at the disc may vary due to the application. One example of a design is a disc with an outer diameter of about 200 mm. At this disc there are 260 prisms, each having an outer diameter of about 8 mm.

The disc and the prisms may be made from the same or different materials. Preferrably they are made as one piece from polycarbonate, which has properties as required in many applications regarding index of refraction, light transmission and mechanical strength. Another possible embodiment is a disc from a freely chosen material having a number of holes which corresponds to the number of prisms and a separate prism inserted into each hole.

Figure 2:
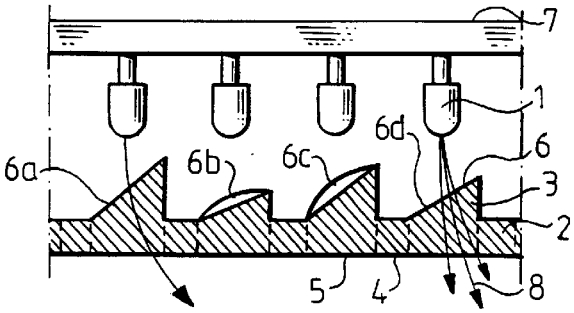
FIG. 2 shows a cross section through a part of the disc and corresponding light sources.

FIG. 2 shows a cross section of a part of the disc with prisms, four of which are shown in the figure, and with light sources connected with the prisms. These are light emitting diodes 1, each of which emits a well concentrated light beam. The spread of the light beam is often about 2°–4° from the centre axis of the diode. The light beam is directed onto the oblique surface 6 of each prism and is refracted by this surface. Thereupon the light beam passes through the prism and is again refracted by the outer surface 5, which may be common with the outer surface 4 of the disc. For the surface which is designated 6*a* also the outermost light is shown and it is seen that all of the emitted light passes through the prism. Only insignificant quantities of stray light finds other paths.

The oblique surfaces 6 of each prism may be varied with respect to both the angle at the centre axis of the prism and the direction of the surface. In the figure the surfaces 6*a* and 6*d* have the same direction but different angles, while the surfaces 6*b* and 6*c* have a somewhat different direction.

Figure 3:
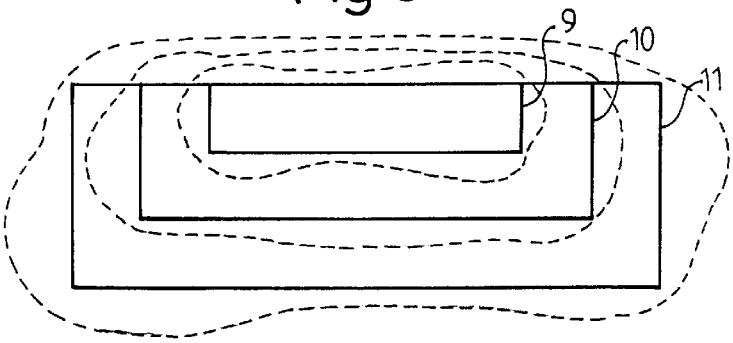
FIG. 3 shows an example of a light pattern.

One example of a desired light pattern is shown in FIG. 3, which in the form of a diagram shows the desired light strength in a vertical plane at a certain distance from the lighting device. The rectangular, full lines indicate the desired values and the broken irregularly shaped lines show the results of a metering of the strength of the light emitted from a device according to the invention.

Figure 4A:
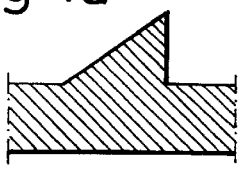
FIGS. 4*a*–4*c* show some different designs of prisms at the disc.
Figure 4B:
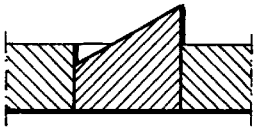
Figure 4C:
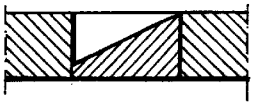

FIGS. 4*a*–4*c* shows different designs of the prisms and the corresponding disc. Preferably the prisms and the disc are made as one unit by injection molding of polymer, where polycarbonate has turned out to have the most suitable combination of properties. The oblique surface of the prism touches the inner surface of the disc and then protrudes therefrom, so that there is no pit or the like in the unit. Alternatively, the the disc and prism unit may be produced by drilling holes into an overall flat disc whereupon individual prisms are placed in the holes. The prisms may then be of different size as shown in FIGS. 4*b* and 4*c*. The last mentioned embodiment will preferably be used only when a very small number of identical devices shall be produced and the costs for making a mould or adaption of an existing mould for injection moulding are too high. When making these moulds it is preferred that the oblique surfaces of the prisms be formed on the surfaces of small, exchangeable parts of the mould. In this way changes and adaptations are easily possible and at a much lower cost than if the complete mould would have to be replaced. The replaceable details of the mould are controlled in some way, e. g. by means of a flattened surface, so that they can not be freely turned around their axis when they are mounted into the mould. This also applies to individual prisms when they are made as inserts into holes in a common disc.

The invention makes it possible to obtain a desired light pattern with much increased precision. Adjustments as desired are easily made and, e.g., left and right designs are easily obtainable. One plate with light emitting diodes may produce different light patterns which may be exchanged and adapted to changing conditions.

I claim:

1. A device for obtaining a light pattern having predetermined intensity and shape, comprising:

a light source, which emits several parallel light beams;

a prism corresponding to each light beam through which the beam passes, all of the prisms being integral parts of a common disc, wherein the common disc has a flat surface over which the prisms are distributed and which also forms one surface of the prisms, and that the surfaces of the prisms which are oblique thereto are positioned adjacent to the opposite surface of the disc.

2. A device according to claim 1, wherein each prism is a straight circular cylinder having one end surface at a right angle to the axis of the cylinder and one end surface oblique to the axis of the cylinder.

3. A device according to claim 1 or 2, wherein each prism is mounted into a corresponding hole in the common disc.

4. An illumination device, comprising:

a common disc having a flat surface and a plurality of prisms distributed over said flat surface such that a surface of each of said plurality of prisms forms a part of said flat surface of said common disc;

a light source disposed proximate to said common disc, wherein said light source has a plurality of light emitting elements, and each light emitting element is disposed proximate to a light receiving surface of one of said plurality of prisms.

5. An illumination device according to claim 4, wherein substantially each prism of said plurality of prisms has one and only one closest light emitting element such that light from each light emitting element passes primarily through only one corresponding prism.

6. An illumination device according to claim 4 or 5, wherein each prism of said plurality of prisms is a straight circular cylinder having a cylinder axis which is substantially perpendicular to said surface that forms a part of said flat surface of said common disc.

7. An illumination device according to claim 6, wherein each prism of said plurality of prisms has a light receiving surface which forms an oblique angle with said cylinder axis at an opposing end of said cylinder axis from said surface that forms a part of said flat surface of said common disc.

8. An illumination device according to claim 6, wherein each prism is mounted into a corresponding hole defined by said common disc.

9. An illumination device according to claim 7, wherein each prism is mounted into a corresponding hole defined by said common disc.

* * * * *